US009931737B2

(12) United States Patent
Kao et al.

(10) Patent No.: US 9,931,737 B2
(45) Date of Patent: Apr. 3, 2018

(54) RATCHET WRENCH WITH EFFICIENT DRIVER CHANGING FUNCTION

(71) Applicant: Yu-En Kao, Taichung (TW)

(72) Inventors: Chien-Chuan Kao, Taichung (TW); Chao-Chih Liu, Taichung (TW)

(73) Assignee: Yu-En Kao, Taichung (TW)

( * ) Notice: Subject to any disclaimer, the term of this patent is extended or adjusted under 35 U.S.C. 154(b) by 309 days.

(21) Appl. No.: 14/981,025

(22) Filed: Dec. 28, 2015

(65) Prior Publication Data

US 2017/0182638 A1 Jun. 29, 2017

(51) Int. Cl.
*B25B 13/46* (2006.01)

(52) U.S. Cl.
CPC ..... *B25B 13/463* (2013.01)

(58) Field of Classification Search
CPC .... B25B 13/463; B25B 13/461; B25B 13/462
See application file for complete search history.

(56) References Cited

U.S. PATENT DOCUMENTS

| | | | | |
|---|---|---|---|---|
| 7,165,479 | B1 * | 1/2007 | Lee | B25B 13/463 81/60 |
| 9,205,538 | B2 * | 12/2015 | Yang | B25B 13/463 |
| 9,789,593 | B2 * | 10/2017 | Kao | B25B 13/463 |
| 2003/0005795 | A1 * | 1/2003 | McCann | B25B 13/463 81/63.2 |
| 2010/0000376 | A1 * | 1/2010 | Hu | B25B 13/463 81/63.1 |
| 2016/0214241 | A1 * | 7/2016 | Kao | B25B 23/0035 |
| 2016/0229042 | A1 * | 8/2016 | Shyu | B25B 23/0035 |

* cited by examiner

*Primary Examiner* — David B Thomas
(74) *Attorney, Agent, or Firm* — WPAT, PC

(57) ABSTRACT

A ratchet wrench with efficient driver changing function includes a wrench body having a head and a handle, a first slot passing through the first side and connected with a second slot; a ratchet ring, rotatable disposed in the first slot and having a polygonal inner hole for receiving a driver; a direction switching member, disposed in the second slot and having a rotating operation mode and a pressing operation mode; a ratchet block, disposed between the first slot and the second slot that when the direction switching member is at the rotating operation mode, the ratchet ring is driven unidirectionally; a top lid, fixed on the head; and a position limiting plate disposed between the top lid and the head that when the direction switching member is at the pressing operation mode, the position limiting plate engages or disengages the driver.

15 Claims, 6 Drawing Sheets

RATCHET WRENCH WITH EFFICIENT DRIVER CHANGING FUNCTION

BACKGROUND OF THE INVENTION

1. Field of the Invention

The present invention relates to ratchet wrenches, and more particularly, to a ratchet wrench with efficient driver changing function.

2. Description of the Related Art

As shown by Taiwan patent 1490088, a wrench tool with engaging device is disclosed, comprising a wrench body; a tool seat, disposed on the wrench body, having a socket and convexly provided with a convex ring projecting from the wrench body, with the outer face of the convex ring having at least one socket bore connected with the socket; a ring sleeve, having a sliding groove for being mounted around the convex ring of the tool seat, one end of the sliding groove convexly provided at least one engaging portion engaged with the socket bore of the tool seat and projecting from the socket of the tool seal. With the engaging portion of the ring sleeve rigidly engaged a tool, the tool is mounted to be positioned, preventing the tool from accidentally detaching from the wrench tool during operation.

However, regarding to such wrench tool, a socket bore is needed to be processed upon the tool seat for the engaging portion of the ring sleeve to be engaged therewith. Based on the structure that the socket bore is connected with any inner angle of the socket, the structural strength of the tool seat is affected. Also, the manufacturing process is complicated.

In addition, the ring sleeve is disposed on the bottom surface of the wrench tool. During operation, user needs to use one hand to grip the wrench body with the other hand pushing the ring sleeve, failing to meet the convenience and efficiency of usage.

SUMMARY OF THE INVENTION

For improving the aforementioned issues, a ratchet wrench with efficient driver changing function is disclosed. The direction switching member is provided with a rotating operation mode and a pressing operation mode. When the direction switching member is at the rotating operation mode, the ratchet ring is unidirectionally driven to rotate; when the direction switching member is at the pressing operation mode, the position limiting plate is driven to slidingly move, whereby the driver detaches from the wrench body.

For achieving the objectives above, a ratchet wrench with efficient driver changing function is provided, comprising:

a wrench body, having a head and a handle extending from the head, the head having a first side and a second side disposed in interval and opposite to the first side, a first slot passing through the first side and the second side, one side of the first slot connected with a second slot;

a ratchet ring, rotatable disposed in the first slot and provided with a polygonal inner hole for receiving a driver;

a direction switching member, disposed in the second slot and provided with a rotating operation mode and a pressing operation mode against the second slot;

a ratchet block, disposed between the first slot and the second slot, such that when the direction switching member is at the rotating operation mode, the direction switching member triggers the ratchet block to engage the ratchet ring, so that the ratchet ring is driven to rotate unidirectionally;

a top lid, fixed on the head; and a position limiting plate, disposed between the top lid and the head, such that when the direction switching member is at the pressing operation mode, the position limiting plate slidingly reciprocates along a direction vertical to the axial direction of the first slot, thereby engaging or disengaging the driver.

Also, the top lid has a moving recess and a through hole, the moving recess receiving the position limiting plate. The position limiting plate has an engaging end and a flange disposed in the through hole. The engaging end engages the driver, and the flange is pushed by the direction switching member, whereby the position limiting plate slidingly moves.

Also, one end of the second slot is transversely connected with a spring groove for receiving a spring. The spring member pushes the position limiting plate, so as to keep the position limiting plate engaging the driver.

With such configuration, the general structure of the present invention does not need an additional switch to engage or disengage the driver, simplifying the components and facilitating the operation. Furthermore, during operation, user is able to grip the handle and press the direction switching member directly, so as to easily engage or disengage the driver, thus meeting the convenience of usage.

DETAILED DESCRIPTION OF THE INVENTION

Figure 1:
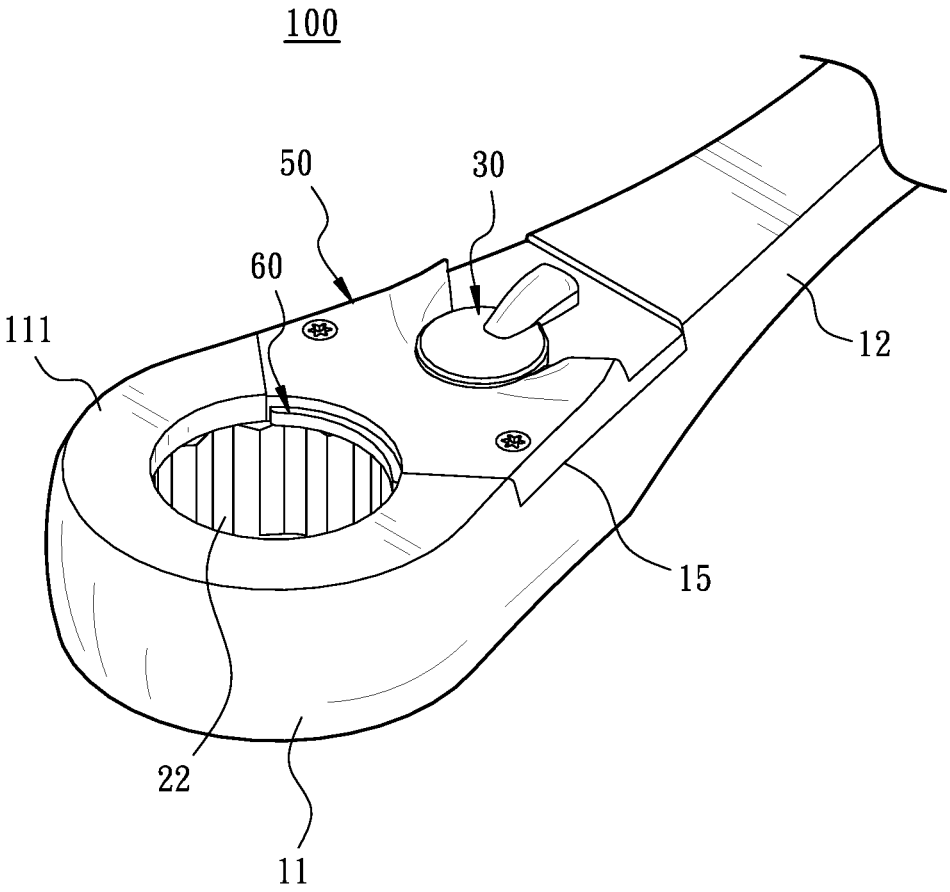
FIG. 1 is a perspective view of the ratchet wrench in accordance with the present invention.
Figure 2:
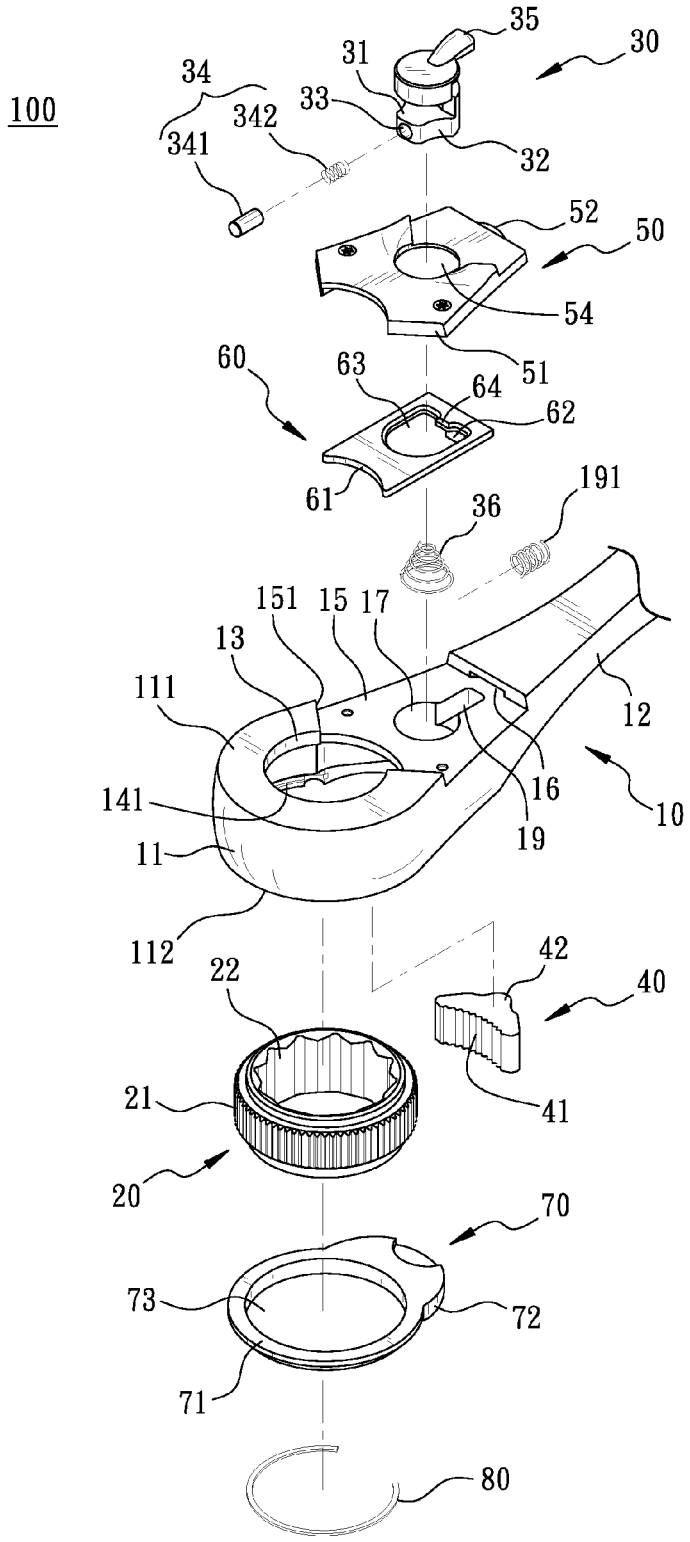
FIG. 2 is an exploded view of the ratchet wrench.
Figure 3:
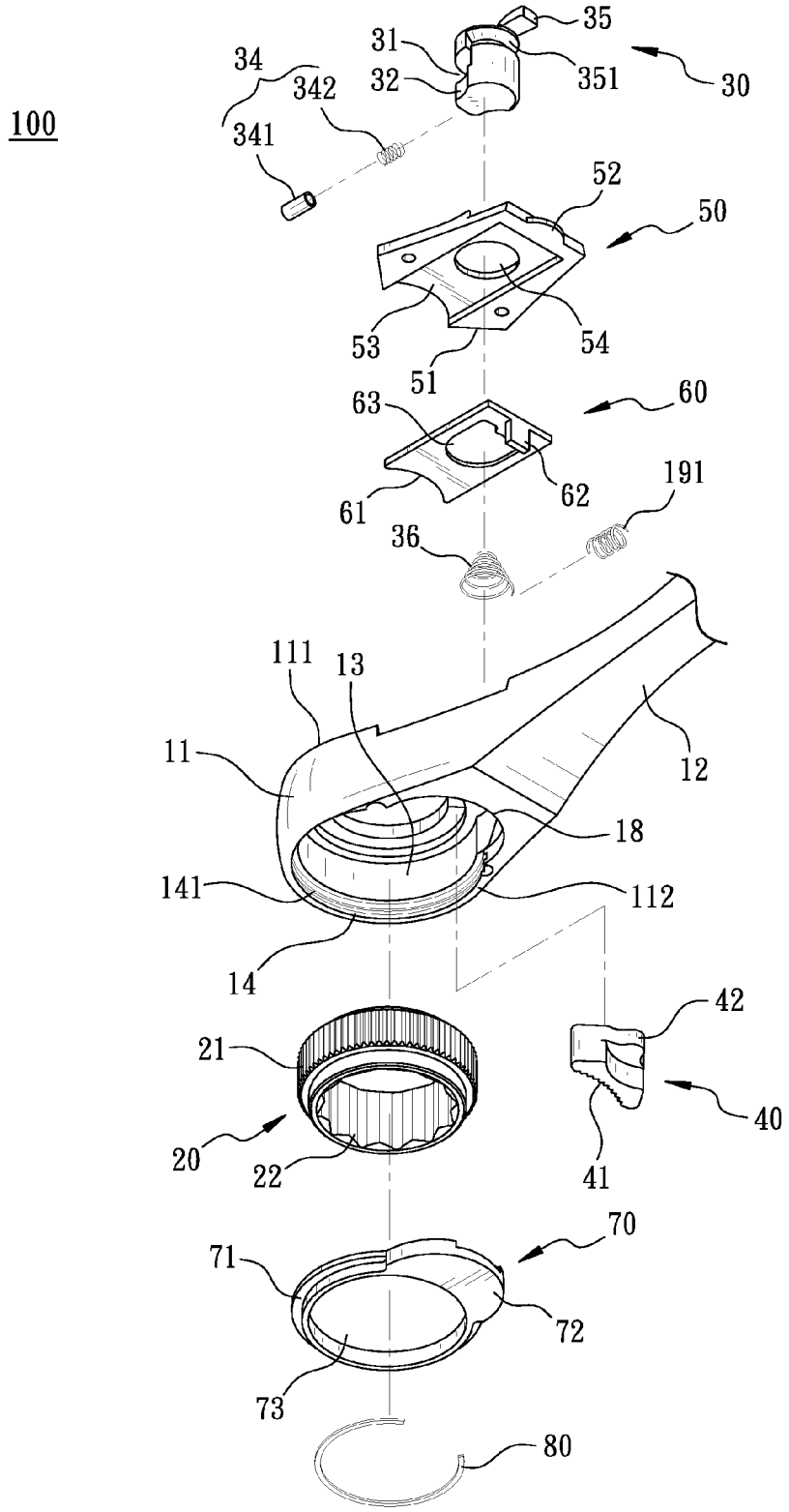
FIG. 3 is an exploded view of the ratchet wrench from another viewpoint.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 6, a ratchet wrench 100 with efficient driver changing function in accordance with the present invention comprises a wrench body 10, a ratchet ring 20, a direction switching member 30, a top lid 50, a position limiting plate 60, and a bottom lid 70.

The wrench body 10 has a head 11 and a handle 12 extending from the head 11. The head 11 is provided with a first side 111 and a second side 112 disposed in interval and opposite to the first side 111. A first slot 13 passes through the first side 111 and the second side 112. The first slot 13 is circular and provided with a side groove 14 adjacent to the second side 112. An engaging groove 141 is internally mounted around the side groove 14. Also, a platform 15 is disposed on the first side 111 adjacent to the handle, and the height of the platform 15 is lower than the height of the first side 111. Two sides of the front edge of the platform 15 adjacent to the first slot 13 are provided with a bevel 151, respectively. A hole 16 is disposed on the rear edge of the platform 15 adjacent to the handle 12.

A circular second slot 17 is vertically and concavely disposed on the platform 15 and connected with one side of the first slot 13 disposed on the head 11. Also, an arc-shaped third slot 18 is disposed between and at the same time connected with the first slot 13 and the second slot 17. The third slot 18 opens toward the second side 112. Rear slide of the second slot 17 further has a spring groove 19 transversely connected to the second slot 17 for receiving a spring member 191.

Figure 4:
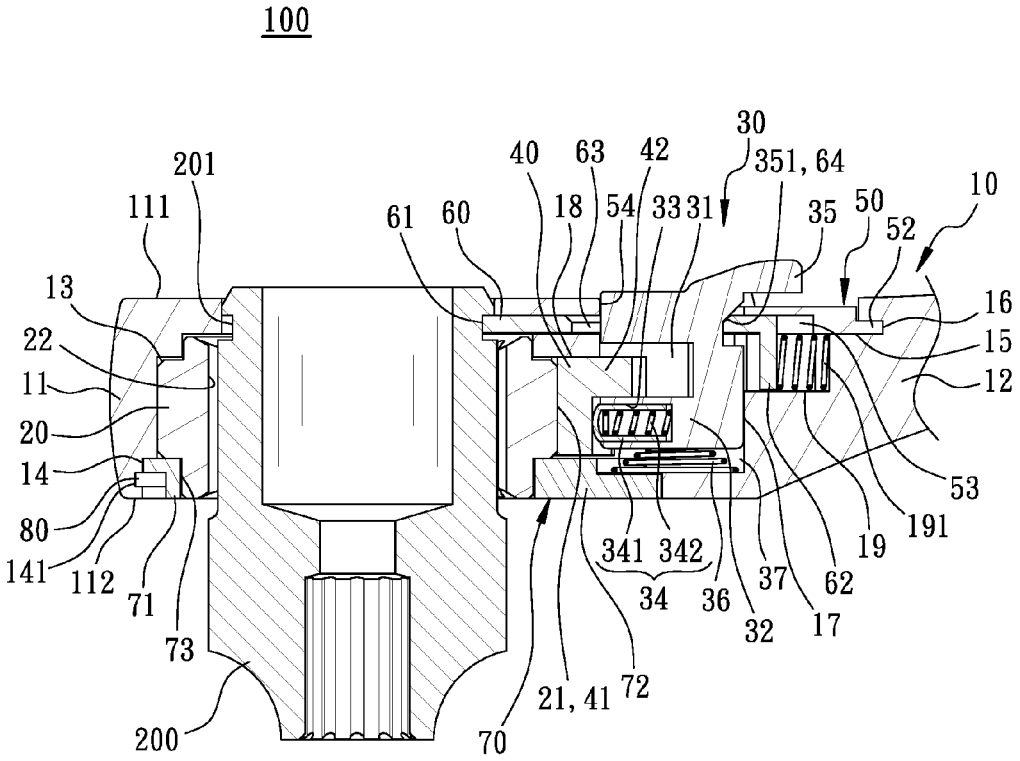
FIG. 4 is a sectional view of the ratchet wrench illustrating the driver being engaged with the head.

The ratchet ring 20 is rotatable disposed in the first slot 13. Outer periphery of the ratchet ring 20 has plural teeth 21. Also, the ratchet ring 20 is provided with a polygonal inner hole 22 for engaging a driver 200. The driver 200 is formed of a barrel sleeve with one end thereof having a ring groove 201, as shown in FIG. 4.

The direction switching member 30 is disposed in the second slot 17 and switchable between a rotating operation mode and a pressing operation mode against the second slot 17. In other words, the direction switching member 30 is allowed to rotate or ascend and descent against the second slot 17.

Front side of the direction switching member 30 is concavely provided with a receiving portion 31, and the lower edge of the receiving portion 31 has a bottom part 32. The bottom part 32 is transversely provided with a column bore 33 for receiving a pushing device 34. The pushing device 34 has a pushing column 341 and a resilient member 342 disposed in the pushing column 341. The resilient member 342 enables the pushing column 341 to push against a ratchet block 40, such that the ratchet block 40 is engaged with the teeth 21 of the ratchet ring 20. The ratchet block 40 is disposed in the third slot 18, with a front side of the ratchet block 40 having a toothed part 41 and a rear side of the ratchet block 40 convexly provided with an installation part 42 for being received by the receiving portion 31.

A top end of the direction switching member 30 further has an operation part 35 exposed on the second slot 17. When user operates the operation part 35, the pushing device 34 pushes the ratchet block 40, such that one side of the ratchet block 40 engages the ratchet ring 20, whereby the ratchet ring 20 is driven to rotate unidirectionally.

Furthermore, a bottom edge of the operation part 35 of the direction switching member 30 has an arc bevel 351. In addition, a recovering spring 36 is disposed in the second slot 17, wherein the lower end of the recovering spring 36 is wider than the upper end of the recovering spring 36. The bottom surface of the second slot 17 has a recess 37 for receiving the lower end of the recovering spring 36. Also, the upper end of the recovering spring 36 pushes the bottom edge of the direction switching member 30, so as to push the direction switching member 30 toward the platform 15. As a result, when the direction switching member 30 is pressed by an external force and such external force is larger than the prestressing force of the recovering spring 36, the direction switching member 30 is allowed to descend against the second slot 17. When the external force is removed, the direction switching member 30 is recovered to the original position, whereby the direction switching member 30 reciprocates up and down in the second slot 17.

The top lid 50 is fixed to the head 11. Preferably, the top lid 50 is embedded on the platform 15 and disposed on the same side with the operation part 35 of the direction switching member 30. Two sides of one end of the top lid 50 are provided with a slant edge 51, respectively, for contacting the two bevels 151, while the other end of the top lid 50 is provided with a convex portion 52 for being inserted into the hole 16. Further, one lateral side of the top lid 50 has a rectangular shaped moving recess 53, and the top lid 50 further has a through bore 54 connected with the moving recess 53. The through bore 54 is coaxially disposed with the second slot 17 for the direction switching member 30 to pass therethrough and for the operation part 35 to be exposed.

The position limiting plate 60 is disposed between the top lid 50 and the head 11. In the embodiment of the present invention, the position limiting plate 60 is received in the moving recess 53 of the top lid 50. Also, the position limiting plate 60 has an engaging end 61 and a blocking portion 62 vertically disposed in opposite against the engaging end 61. The engaging end 61 is formed in a concave arc shape. The blocking portion 62 is disposed in the spring groove 19 and contacted and pushed by the spring member 191, such that the engaging end 61 is permanently engaged with the ring groove 201 of the driver 200, whereby the driver 200 is stably positioned in the head 11 of the wrench body 10.

A through hole 63 is disposed on the position limiting plate 60 between the engaging end 61 and the blocking portion 62. The through hole 63 is coaxially disposed with the second slot 17 and passed through by the direction switching member 30. Also, one side of the inner edge of the through hole 63 is provided with a flange 64 corresponding to the arc bevel 351 of the direction switching member 30. Therefore, when the direction switching member 30 is pressed, the arc bevel 351 pushes the flange 64, forcing the position limiting plate 60 to slide toward the handle 12, whereby the engaging end 61 detached from the ring groove 201. When the direction switching member 30 is at the pressing operation mode, the direction switching member 30 triggers the position limiting plate 60 to reciprocate along a direction vertical to the axial direction of the first slot 13, so as to optionally engage or disengage the driver 200.

The bottom lid 70 has a combining part 71 on one end thereof, with the other end provided with a covering part 72. A sleeve hole 73 is disposed between the combining part 71 and the covering part 72. The combining part 71 of the bottom lid 70 is disposed in the side groove 14. The covering part 72 is combined to the opening of the third slot 18, so as to prevent the ratchet block 40 from detaching from the head 11. Also, the bottom lid 70 is engaged in the engaging groove 141 by use of a C clamp 80, wherein the sleeve hole 73 of the bottom lid 70 is passed through by one end of the driver 200.

As shown in FIG. 4, normally, the direction switching member 30 is pushed upward by the recovering spring 36, so that the direction switching member 30 does not push the position limiting plate 60. At the same time, the position limiting plate 60 is pushed by the spring member 191, so that the position limiting plate 60 tends to move toward the first slot 13. As a result, the engaging end 61 of the position limiting plate 60 is engaged with the ring groove 201 of the driver 200, such that the driver 200 is stably engaged with the head 11 for subsequent operation by the user.

Figure 5:
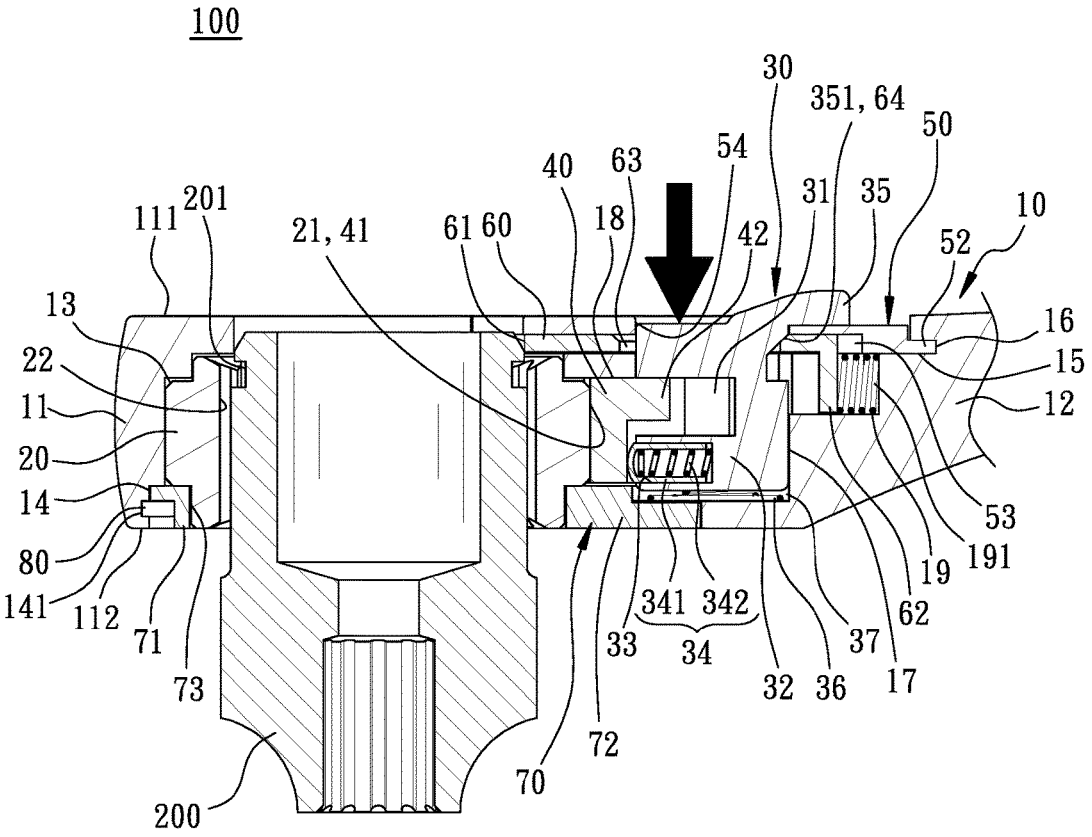
FIG. 5 is a first schematic view of the operation status of the ratchet wrench, illustrating the direction switching member being pressed to push the position limiting plate.
Figure 6:
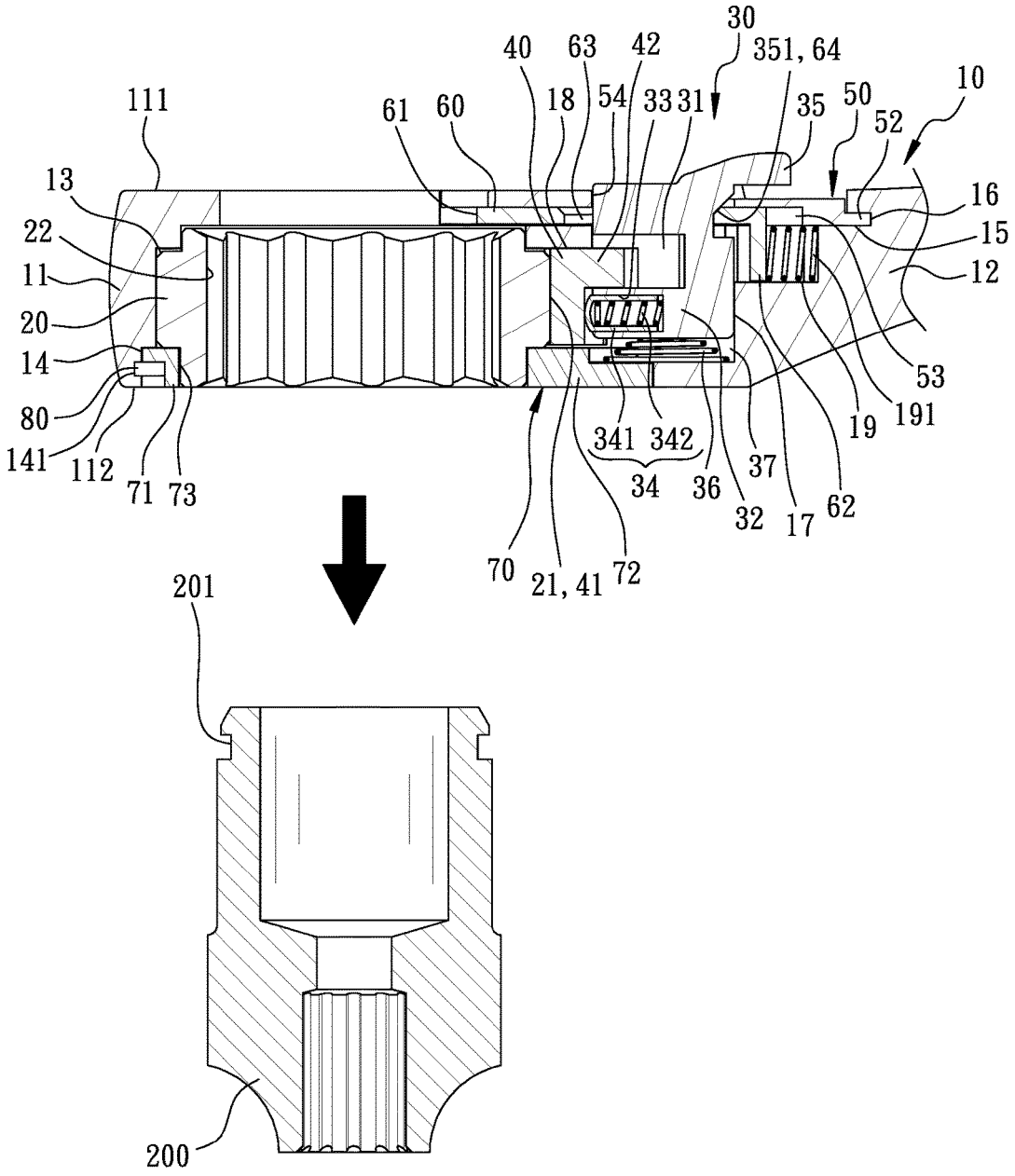
FIG. 6 is a second schematic view of the operation status of the ratchet wrench, illustrating the driver detaching from the head.

As shown in FIG. 5 and FIG. 6, when the direction switching member 30 is pressed by an external force, the direction switching member 30 descends against the second slot 17, causing the recovering spring 36 to be compressed, whereby the arc bevel 351 of the operation part 35 of the direction switching member 30 pushes the flange 64 of the position limiting plate 60, forcing the position limiting plate 60 to move in the moving recess 53 toward the handle 12. As a result, the engaging end 61 of the position limiting plate 60 detaches from the ring groove 201 of the driver 200, so that the driver 200 is allowed to be removed from the head 11 toward the second side 112.

With such configuration, by use of the operation of the direction switching member 30, the driver 200 is efficiently removed from the head 11, facilitating the fast changing process of the driver 200.

To sum up, the direction switching member 30 achieves both a direction switching function and an efficient engaging and disengaging function against the driver 200. No additional switch is needed to be provided on the general structure to fulfill the engagement and disengagement against the driver 200. Therefore, the general structure is simplified and conveniently operated.

More importantly, during the operation, the user is able to grip the handle 12 and directly press the direction switching member 30 for engaging or disengaging the driver 200, achieving the convenience of usage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wrench with efficient driver changing function, comprising:

a wrench body, having a head and a handle extending from the head, the head having a first side and a second side disposed in interval and opposite to the first side, a first slot passing through the first side and the second side, one side of the first slot connected with a second slot;

a ratchet ring, rotatable disposed in the first slot and provided with a polygonal inner hole for receiving a driver;

a direction switching member, disposed in the second slot and provided with a rotating operation mode and a pressing operation mode against the second slot;

a ratchet block, disposed between the first slot and the second slot, such that when the direction switching member is at the rotating operation mode, the direction switching member triggers the ratchet block to engage the ratchet ring, so that the ratchet ring is driven to rotate unidirectionally;

a top lid, fixed on the head; and a position limiting plate, disposed between the top lid and the head, such that when the direction switching member is at the pressing operation mode, the position limiting plate slidingly reciprocates along a direction vertical to the axial direction of the first slot, whereby the driver is engaged or disengaged.

2. The ratchet wrench of claim 1, wherein the top lid has a through bore, the position limiting plate has a through hole, and the through hole and the through bore are coaxially disposed with the second slot for the direction switching member to pass therethrough.

3. The ratchet wrench of claim 2, wherein the position limiting plate has an engaging end and a flange disposed in the through hole, the engaging end engaging the driver, and the flange pushed by the direction switching member, such that the position limiting plate slidingly moves.

4. The ratchet wrench of claim 3, wherein the engaging end is formed in a concave arc shape.

5. The ratchet wrench of claim 3, wherein a recovering spring is disposed in the second slot for pushing the direction switching member.

6. The ratchet wrench of claim 5, wherein a bottom surface of the second slot has a recess for receiving one end of the recovering spring, and the other end of the recovering spring pushes a bottom edge of the direction switching member.

7. The ratchet wrench of claim 1, wherein one lateral side of the top lid has a moving recess for receiving the position limiting plate.

8. The ratchet wrench of claim 1, wherein one end of the second slot is transversely connected with a spring groove for receiving a spring member, and the spring member pushes the position limiting member, such that the position limiting member permanently engages the driver.

9. The ratchet wrench of claim 7, wherein one end of the position limiting plate is vertically provided with a blocking portion for contacting the spring member.

10. The ratchet wrench of claim 1, wherein the direction switching member is concavely provided with a receiving portion, and a rear side of the ratchet block is convexly provided with an installation part to be received in the receiving portion.

11. The ratchet wrench of claim 10, wherein a lower edge of the receiving portion has a bottom part, the bottom part has a column bore for receiving a pushing device, and the pushing device pushes the ratchet block.

12. The ratchet wrench of claim 1, wherein a platform is disposed on the first side adjacent to the handle for receiving the top lid.

13. The ratchet wrench of claim 12, wherein a hole is disposed on the platform adjacent to the handle, and the top lid has a convex portion for being inserted in the hole.

14. The ratchet wrench of claim 1, further comprising a bottom lid, the bottom lid passed through by one end of the driver, and the bottom lid disposed in the first slot adjacent to the second side by use of a C clamp.

15. A ratchet wrench with efficient driver changing function, comprising:

a wrench body, having a head and a handle extending from the head, the head having a first side and a second side disposed in interval and opposite to the first side, a first slot passing through the first side and the second side, one side of the first slot connected with a second slot, a platform concavely disposed on the first side adjacent to the handle, the second slot transversely connected with a spring groove;

a ratchet ring, rotatable disposed in the first slot and provided with a polygonal inner hole for receiving a driver;

a direction switching member, disposed in the second slot and provided with a rotating operation mode and a pressing operation mode against the second slot;

a ratchet block, disposed between the first slot and the second slot, such that when the direction switching member is at the rotating operation mode, the direction switching member triggers the ratchet block to engage the ratchet ring, so that the ratchet ring is driven to rotate unidirectionally;

a top lid, fixed on the head, with a moving recess disposed between the top lid and the platform;

a position limiting plate, slidingly disposed in the moving recess, one end of the position limiting plate having an engaging end for engaging the driver, the other end of the position limiting plate having a flange; and a spring member, disposed in the spring groove for contacting the position limiting plate, such that the engaging end of the position limiting plate permanently engages the driver; when the direction switching member is pressed, the direction switching member pushes the flange, so as to trigger the engaging end to detach from the driver, facilitating the removal of the driver from the inner hole.

* * * * *